US008075955B2

(12) United States Patent
Taguchi et al.

(10) Patent No.: US 8,075,955 B2
(45) Date of Patent: Dec. 13, 2011

(54) METHOD FOR MAKING POSITIVE PHOTOSENSITIVE PLANOGRAPHIC PRINTING PLATE

(75) Inventors: Takao Taguchi, Haibara-gun (JP); Ikuo Kawauchi, Haibara-gun (JP)

(73) Assignee: Fujifilm Corporation, Tokyo (JP)

( * ) Notice: Subject to any disclaimer, the term of this patent is extended or adjusted under 35 U.S.C. 154(b) by 939 days.

(21) Appl. No.: 12/050,735

(22) Filed: Mar. 18, 2008

(65) Prior Publication Data

US 2008/0241393 A1 Oct. 2, 2008

(30) Foreign Application Priority Data

Mar. 29, 2007 (JP) ..... 2007-087977

(51) Int. Cl.
*B05D 3/02* (2006.01)
*B05D 3/04* (2006.01)

(52) U.S. Cl. ..... 427/377; 427/378; 427/379; 427/384; 427/385.5; 427/407.1

(58) Field of Classification Search ..... 427/377, 427/378, 379, 384, 385.5, 407.1
See application file for complete search history.

(56) References Cited

U.S. PATENT DOCUMENTS 1,424,969 A * 8/1922 White ..... 427/374.1
2005/0058936 A1 * 3/2005 Kawauchi et al. ..... 430/270.1

FOREIGN PATENT DOCUMENTS

JP 11-218914 A 8/1999
JP 2004-205720 A 7/2004
WO 2007/136005 A1 11/2007

* cited by examiner

*Primary Examiner* — Elena T Lightfoot
(74) *Attorney, Agent, or Firm* — Sughrue Mion, PLLC

(57) ABSTRACT

A method for making a positive photosensitive planographic printing plate including of a base having formed thereon in this order an undercoat layer and an image recording layer, wherein the undercoat layer is obtained by applying an undercoat layer solution containing a solvent and an acrylic resin having an alkali-soluble group, followed by drying the coating, the image recording layer contains a novolac resin and an infrared absorbing agent, and the applied undercoat layer solution is dried in an undercoat layer drying step which includes a steam-containing hot air drying step using steam-containing hot air having a temperature of 90° C. to 200° C., and a relative humidity of 8% to 70%.

2 Claims, 4 Drawing Sheets

METHOD FOR MAKING POSITIVE PHOTOSENSITIVE PLANOGRAPHIC PRINTING PLATE

CROSS-REFERENCE TO RELATED APPLICATION

This application claims priority under 35 USC 119 from Japanese Patent Application No. 2007-087977, the disclosure of which is incorporated by reference herein.

BACKGROUND OF THE INVENTION

1. Field of the Invention

The present invention relates to a method for making a photosensitive planographic printing plate, and specifically relates to a method for making an infrared laser-sensitive positive photosensitive planographic printing plate for so-called direct plate-making, wherein the printing plate is directly made based on digital signals output from a computer or the like.

2. Description of the Related Art

With the remarkable progress of lasers in recent years, high-power, small-sized solid lasers and semiconductor lasers having emission regions in the near infrared to infrared regions are now readily available. These lasers are extremely useful as light sources for making printing plates directly from digital data output from computers or the like.

Infrared laser-sensitive positive photosensitive planographic printing plates are known as planographic printing plates which are exposed to an infrared laser having an emission region in the above-described infrared region. An infrared laser-sensitive positive photosensitive planographic printing plate is composed of a hydrophilic base having thereon a photosensitive layer composed essentially of a binder resin which is soluble in an aqueous alkali solution, and an infrared absorbing dye (IR dye) which absorbs light to generate heat. Before the infrared laser-sensitive positive photosensitive planographic printing plate is exposed, the infrared absorbing dye interacts with the binder resin to serve as a dissolution inhibitor for the binder resin. Once the photosensitive layer is exposed to infrared rays, heat generates in the infrared exposed areas (non-image areas) which are the exposed area, and the generated heat weakens the interaction between the infrared absorbing dye and the binder resin to solubilize the binder resin in the alkali developer. Accordingly, when the infrared laser-sensitive positive photosensitive planographic printing plate after exposure is developed with an alkali developer, the infrared exposed areas (non-image areas) are dissolved in the alkali developer, whereby an image is formed according to the laser exposure.

However, under the system, the difference in the degree of insolubility of the unexposed areas in the developer and solubility of the exposed areas is so small that excessive development and development failures have tended to occur. In addition, minute surface defects caused during handling may result in defective printing durability. Japanese Patent Application Laid-Open (JP-A) No. 11-218914 proposes a multilayered photosensitive planographic printing plate composed of a hydrophilic base having thereon an undercoat layer which contains an acrylic resin having an alkali-soluble group such as a sulfonamide group, and a top layer which contains a novolac resin and a photothermal converting agent, wherein the top layer increases in solubility in alkaline water upon exposure. In the planographic printing plate of this type, the top layer in the infrared exposed areas is dissolved and removed by alkaline water to expose the undercoat layer having high alkali solubility, which results in notable difference in the solubility of the unexposed and exposed areas.

In general, a photosensitive planographic printing plate is made by subjecting a belt-like aluminum web to various surface treatments, applying a photosensitive layer forming solution to the roughened surface of obtained web, and then drying the coating. The above-described multilayered infrared-sensitive planographic printing plate is obtained by applying an undercoat layer and a top layer one by one to form a photosensitive layer. In order to form the multilayered structure, the acrylic resin composing the undercoat layer must be poorly soluble in the solvent applied to the top layer. Therefore, the solvent composing the undercoat layer is commonly a solvent having a high dissolving power on a poorly soluble resin, and examples thereof include γ-butyrolactone and dimethyl sulfoxide (see JP-A No. 2004-205720).

However, the multilayered infrared laser-sensitive positive planographic printing plate has problems such as the minor differences in sensitivity between the end and center portions in the width direction of the aluminum web, and variations in sensitivity due to the changes in conditions such as the thickness of the aluminum web. These phenomena may result in the variation in the dot size after plate making to cause printing problems.

SUMMARY OF THE INVENTION

The present invention has been accomplished in view of the above-described problems, and is intended to provide a method for making a positive photosensitive planographic printing plate, the method allows stable production of favorable products with a small variation in sensitivity, and a small variation in the dot size after plate making.

As a result of a keen study, the inventors have found that the variation in the sensitivity of a multilayered positive photosensitive planographic printing plate is partly due to the temperature variation in the step of drying the undercoat layer, and thereby has been accomplished the invention.

The method for making the positive photosensitive planographic printing plate according to the first aspect of the invention is a method for making a positive photosensitive planographic printing plate comprising a base having formed thereon in this order an undercoat layer and an image recording layer, wherein the undercoat layer is obtained by applying an undercoat layer solution containing a solvent and an acrylic resin having an alkali-soluble group, followed by drying the coating, the image recording layer contains a novolac resin and an infrared absorbing agent, and the applied undercoat layer solution is dried in an undercoat layer drying step which includes a steam-containing hot air drying step using steam-containing hot air having a temperature of 90° C. to 200° C., and a relative humidity of 8% to 70%.

According to the present aspect, the use of the steam-containing hot air having a temperature of 90° C. to 200° C. and a relative humidity of 8% to 70% in the undercoat layer drying step allows favorable removal of the solvent with the temperature variation in the undercoat layer coating is suppressed during drying. The mechanism is that the steam is absorbed in the undercoat layer coating to increase the free volume in the coating, and resultantly the diffusion rate of the residual solvent in the coating remarkably increases to accelerate the removal of the solvent. Under the method, the undercoat layer coating is dried at a lower temperature and more quickly than a conventional hot air drying method without requiring the supply of much heat to the undercoat layer coating, whereby the temperature variation is suppressed. As a result of this, the sensitivity variation in the finished positive photosensitive planographic printing plate is reduced.

The temperature range from 90° C. to 200° C. defined herein is commonly used for drying an undercoat layer.

According to the present aspect, the solvent is removed more quickly than a conventional drying method using dry hot air.

The positive photosensitive planographic printing plate made according to the present aspect may contain, in addition to the undercoat layer and the image recording layer, other layers on the base, such as a surface protective layer and a substrate layer.

The method for making a positive photosensitive planographic printing plate according to the second aspect of the invention is composed of the undercoat layer drying step including a first drying step and the subsequent steam-containing hot air drying step, wherein in the first drying step, the applied undercoat layer solution is dried in a lower humidity than that in the steam-containing hot air drying step until the undercoat layer reaches a dry point.

The dry point refers to a dry condition wherein the surface glossiness of the applied undercoat layer solution does not change any more. The mechanism of the removal of the residual solvent in the steam-containing hot air drying step is expressed after the undercoat layer reaches the dry point. Accordingly, the drying operation in the first drying step before the steam-containing hot air drying step reduces the time taken until the applied undercoat layer solution reaches the dry point, and more effectively removes the solvent in the steam-containing hot air drying step in comparison with the case where the steam-containing hot air is used from the beginning of the undercoat layer drying step.

The method for making a positive photosensitive planographic printing plate according to the third aspect of the invention is composed of the undercoat layer drying step including a second drying step following the steam-containing hot air drying step, wherein the second drying step uses dry hot air having a lower humidity than that in the steam-containing hot air drying step.

As described above, the drying operation in the second drying step after the steam-containing hot air drying step removes the steam absorbed in the undercoat layer.

The method for making a positive photosensitive planographic printing plate according to the fourth aspect of the invention includes the acrylic resin having an alkali-soluble group, wherein the acrylic resin having an alkali-soluble group is a polymer which contains a monomer having a phenolic hydroxy group, a sulfonamide group, or an active imide group as a polymerization component.

According to the present aspect, the variation in the drying temperature between areas is suppressed in the undercoat layer drying step, and the variation in the sensitivity of the finished positive photosensitive planographic printing plate is reduced. In addition, the solvent is removed more quickly in comparison with the conventional drying operation using dry hot air.

BRIEF DESCRIPTION OF THE DRAWINGS

Embodiments of the present invention will be described in detail based on the following figures, wherein.

DETAILED DESCRIPTION OF THE INVENTION

Figure 1:
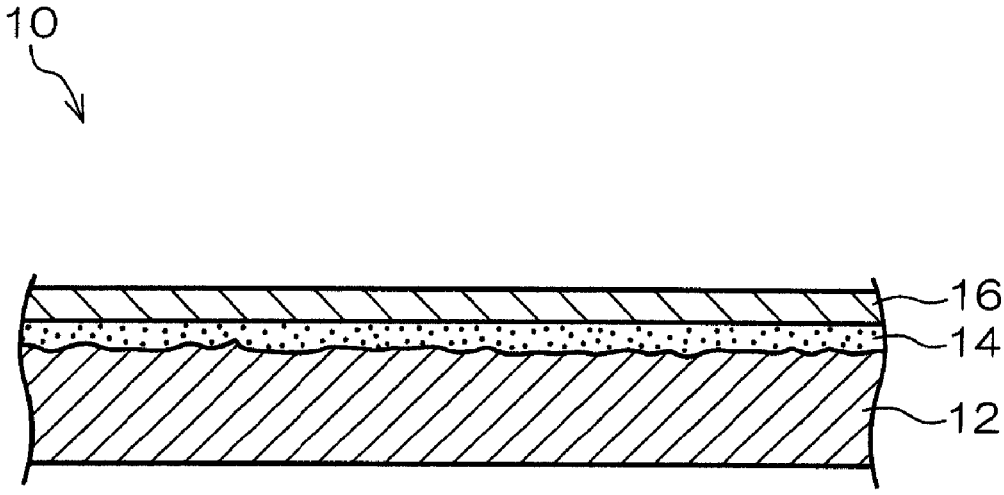
FIG. 1 is a cross sectional view of the positive photosensitive planographic printing plate according to an exemplary embodiment of the present invention.

The exemplary embodiment of the present invention is described below. FIG. 1 shows a cross sectional view of a positive photosensitive planographic printing plate 10 made by the method for making a positive photosensitive planographic printing plate according to the invention.

Figure 2:
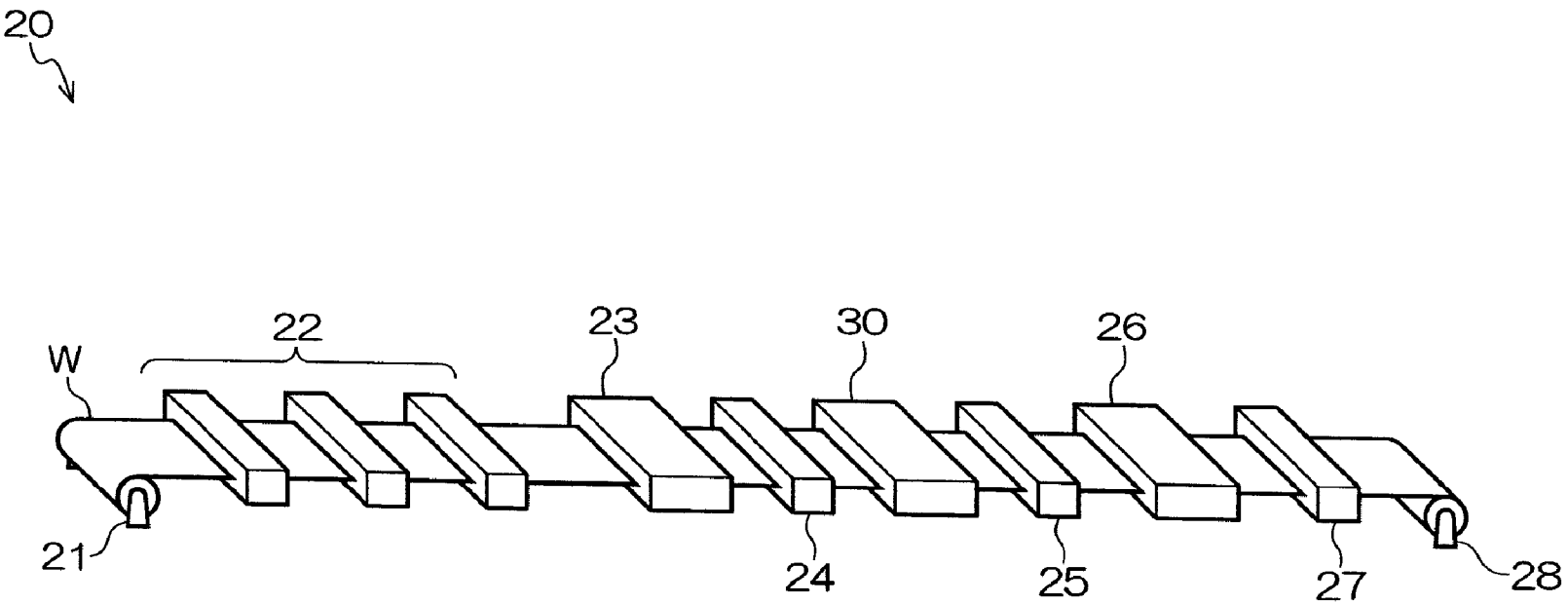
FIG. 2 is a schematic block diagram of the production line according to an exemplary embodiment of the invention.

The positive photosensitive planographic printing plate 10 includes a base 12, an undercoat layer 14, and an image recording layer 16. The positive photosensitive planographic printing plate 10 is made through a production line 20 shown in FIG. 2. The production line 20 includes a feeding device 21, a surface treatment unit 22, a substrate applying/drying unit 23, a substrate cooling unit 24, an undercoat layer applying/drying unit 30, an undercoat layer cooling unit 25, an image recording layer applying/drying unit 26, an image recording layer cooling unit 27, and a winding device 28.

A roll of aluminum web W as a base 12 is mounted on from the feeding device 21, and continuously fed therefrom. The base used in the present exemplary embodiment is a pure aluminum plate or an alloy plate composed mainly of aluminum, and has a thickness of about 0.1 mm to 0.6 mm.

The aluminum web W fed from the feeding device 21 is sent to the surface treatment unit 22, and is subjected to surface treatment in the surface treatment unit 22. The surface treatment roughens the surface of the aluminum web W. The surface roughening treatment may be carried out by various methods. Examples of the method include ball polishing, brush polishing, blast polishing, buff polishing, and electrochemical surface roughening carried out in, for example, a hydrochloric acid or nitric acid electrolytic solution using an alternating current or direct current. In addition, as disclosed in JP-A No. 54-63902, a combination of mechanical surface roughening treatment and electrochemical surface roughening treatment is also useful. The aluminum web W which has been subjected to the surface roughening treatment as described above is subjected to alkali etching treatment and neutralization treatment, and then subjected to anodizing process. Furthermore, the aluminum web W is as necessary subjected to hydrophilizing treatment using, for example, silicate.

The aluminum web W which has been subjected to the surface treatment in the surface treatment unit 22 is then sent to the substrate applying/drying unit 23. In the substrate applying/drying unit 23, a substrate to be provided between the base 12 and the undercoat layer 14 is applied and dried. The substrate may be composed of, for example, a phosphate, an amino acid, or a water-soluble heteropolymer. The substrate is not essential to the positive photosensitive planographic printing plate made in the invention, and the substrate applying/drying unit 23 may be omitted.

Figure 3:
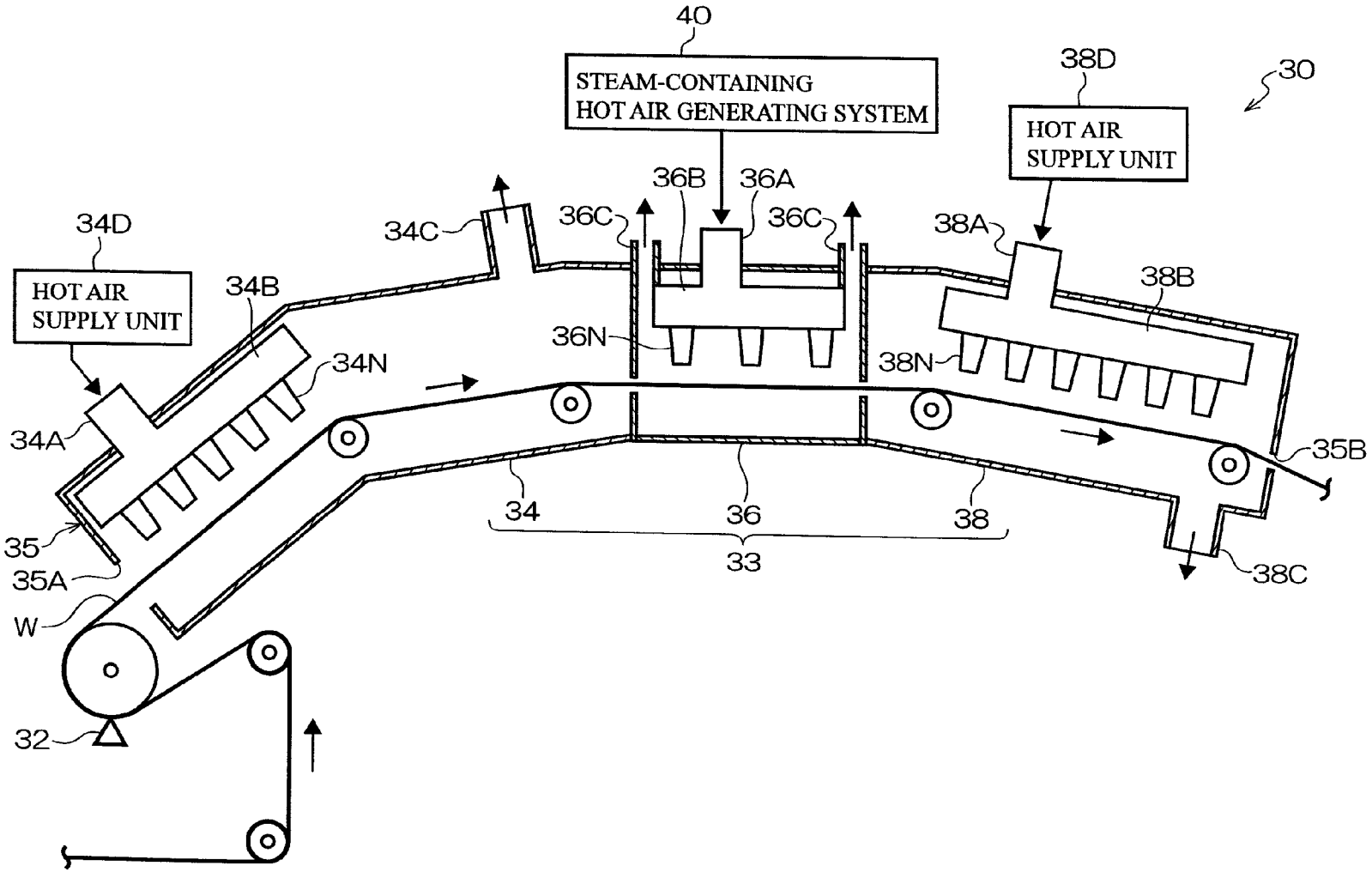
FIG. 3 shows the schematic structure of the undercoat layer applying/drying unit according to an exemplary embodiment of the invention.

The aluminum web W having a substrate formed in the substrate applying/drying unit 23 is cooled to normal temperature in the substrate cooling unit 24, and then sent to the undercoat layer applying/drying unit 30, where the aluminum web W is subjected to undercoat layer drying treatment. As shown in FIG. 3, the undercoat layer applying/drying unit 30 includes an application unit 32 and a drying unit 33. The drying unit 33 comprises a first drying unit 34, a steam-containing hot air drying unit 36, and a second drying unit 38, which are arranged in this order from the upstream to the downstream side.

In the application unit 32, an undercoat layer solution is applied to the surface of the aluminum web W. The method for applying the undercoat layer solution to the base is not particularly limited as long as a coating film having a uniform arbitrary thickness is formed on the aluminum web W. Examples of the method include a method using a coating rod as described in, for example, Japanese Patent Application Publication (JP-B) No. 58-4589 and JP-A No. 59-123568, a method using an extrusion coater as described in, for example, JP-A No. 4-244265, and a method using a slide bead coater as described in JP-B No. 1-57629.

The undercoat layer 14 is further described below in detail.

The undercoat layer 14 is comprised essentially of a polymer compound such as an acrylic resin having an alkali-soluble group, and is formed by applying an undercoat layer solution, which contains the polymer compound and other components dissolved in a solvent having a high dissolving power, to the aluminum web W, and then drying the aluminum web W as described below.

The components contained in the undercoat layer solution are described below.

The acrylic resin having an alkali-soluble group as the main component of the undercoat layer solution is a polymer compound which is insoluble in water and soluble in an aqueous alkali solution. The alkali soluble group is preferably an acid group such as a phenolic hydroxy group, a sulfonamide group, or an active imide group (—$SO_2NHCOR$, —$SO_2NHSO_2R$, —$CONHSO_2R$, wherein R represents a hydrocarbon group). The acrylic resin according to the invention is preferably a polymer containing a monomer having these groups as a polymerization component.

In cases where the acid group is a phenolic hydroxy group, a polymer comprising a monomer having a phenol group in the side chain thereof may be used. Examples of the monomer include phenolic acrylamide, methacrylamide, acrylic ester, methacrylic acid ester, or hydroxystyrene, and specific preferable examples thereof include N-(4-hydroxyphenyl)acrylamide, N-(2-hydroxyphenyl)methacrylamide, N-(4-hydroxyphenyl)methacrylamide, p-hydroxyphenyl methacrylate, and p-hydroxystyrene.

In cases where the acid group is a sulfonamide group, examples of the monomer include a monomer having a sulfonamide group wherein a hydrogen atom is linked to a nitrogen atom, and specific preferable examples thereof include m-aminosulfonylphenyl methacrylate, N-(p-aminosulfonylphenyl)methacrylamide, and N-(p-aminosulfonylphenyl) acrylamide. In cases where the acid group is an active imide group, examples of the monomer include a monomer having an active imide group, and specific preferable examples thereof include N-(p-toluenesulfonyl) methacrylamide, and N-(p-toluenesulfonyl) acrylamide.

The polymer compound preferably contains a monomer having an acid group at a ratio of 10 to 50 mol %, more preferably at a ratio of 20 to 40 mol % or more. Examples of the monomer useful as a copolymer component other than the acid group-containing monomer include aliphatic hydroxy group-containing acrylic esters or methacrylic esters, alkyl acrylates or methacrylates, acrylamides or methacrylamides, vinyl ethers, vinyl esters, styrenes, vinyl ketones, acrylonitriles, unsaturated imides, and unsaturated carboxylic acids.

The alkaline water-soluble polymer compound preferably has a weight average molecular weight of 5,000 to 300,000 and a number average molecular weight of 800 to 250,000. The amount of the polymer compound is from 30 to 99% by weight, preferably from 40 to 95% by weight, and particularly preferably from 50 to 90% by weight with reference to the solid content of the components forming the photosensitive layer. Two or more of the polymer compounds may be used in combination.

In the present exemplary embodiment, examples of the other components to be added to the undercoat layer solution include an infrared absorbing agent, an image coloring agent, and a surfactant for improving coating properties.

The infrared absorbing agent used herein is a dye or pigment having an absorption maximum at the wavelength of 760 nm to 1200 nm, and particularly preferable examples thereof include cyanine dyes. Examples of the image coloring agent include dyes such as Victoria Pure Blue, Crystal Violet (CI 42555), Methyl Violet (CI 42535), and Ethyl Violet. Examples of the surfactant for improving coating properties include a fluorine surfactant, which is used at a ratio of preferably from about 0.01 to 0.5% by mass with reference to the total solid content in the coating solution.

As described above, the polymer compound used in the undercoat layer solution is poorly soluble so as to prevent elution into the image recording layer solution (top layer solution) during application. Therefore, the organic solvent used in the undercoat layer solution must dissolve the poorly soluble polymer. Examples of useful organic solvents include cyclohexanone, methyl lactate, ethyl lactate, N,N-dimethylacetamide, N,N-dimethylformamide, tetramethylurea, N-methylpyrrolidone, dimethyl sulfoxide, sulfolane, and γ-butyrolactone. These solvents may be used alone or as a mixture. These solvents may be mixed with another solvent, for example, methyl ethyl ketone, methanol, ethanol, propanol, ethylene glycol monomethyl ether, 1-methoxy-2-propanol, 2-methoxyethyl acetate, 1-methoxy-2-propyl acetate, or dimethoxyethane.

The coating weight of the undercoat layer solution after drying according to the present exemplary embodiment is preferably from 0.5 to 1.5 $g/m^2$, more preferably from 0.7 to 1.0 $g/m^2$ from the viewpoints of ensuring printing durability and preventing the generation of residual film after development.

After the undercoat layer solution is applied in the application unit 32, the aluminum web W is sent to the drying unit 33. The structure of the drying unit 33 is described below.

The drying unit 33 includes a drying furnace 35 which is a long slender enclosure having an explosion-proof and insulation structure, and being arranged along the transport direction of the aluminum web W. The drying furnace 35 is composed of an inlet 35A and an outlet 35B for the aluminum web W. The inside of the drying furnace 35 is divided into three zones, the first drying unit 34, the steam-containing hot air drying unit 36, and the second drying unit 38, so as to divide the transport path of the aluminum web W into three portions.

The first drying unit 34, steam-containing hot air drying unit 36, and second drying unit 38 have air supply ducts 34A, 36A, and 38A, and exhaust ducts 34C, 36C, and 38C, respectively. The air supply ducts 34A, 36A, and 38A are communicated with rectifying boxes 34B, 36B, and 38B, respectively. The rectifying boxes 34B, 36B, and 38B are placed at upper portions in the drying furnace 35, and include a plurality of blowoff nozzles 34N, 36N, and 38N for blowing hot air on the aluminum web W under transportation. The air supply duct 34A is linked to the hot air supply unit 34D, and hot air is supplied from the hot air supply unit 34D to the air supply duct 34A. The air supply duct 36A is linked to a steam-containing hot air generating system 40, and steam-containing hot air is supplied from the steam-containing hot air generating system 40 to the air supply duct 36A. The air supply duct 38A is linked to the hot air supply unit 38D, and hot air is supplied from the hot air supply unit 38D to the air supply duct 38A.

The first drying step in the first drying unit 34 is further described below.

In the first drying unit 34, the hot air fed from the hot air supply unit 34D is blown by the blowoff nozzles 34N on the aluminum web W thereby drying the undercoat layer solution applied to the aluminum web W. The drying operation in the first drying unit 34 is continued until most of the organic solvent contained in the undercoat layer solution is evaporated, and the undercoat layer reaches the dry point (the point where the surface glossiness of the aluminum web W coated with the undercoat layer solution does not change any more). The drying time and predetermined transportation rate for the aluminum web W in the first drying unit 34 are established so as to the web is dried to the extent as described above. The hot air fed from the hot air supply unit 34D preferably has a temperature of about 60° C. to 200° C., and a relative humidity of 0% to 2%.

The drying system in the first drying step does not necessarily employ heat transfer by convention of hot air, and may employ other system such as conductive heat transfer, radiation heat transfer, or inductive heating.

The steam-containing hot air drying step in the steam-containing hot air drying unit 36 is further described below.

Figure 4:
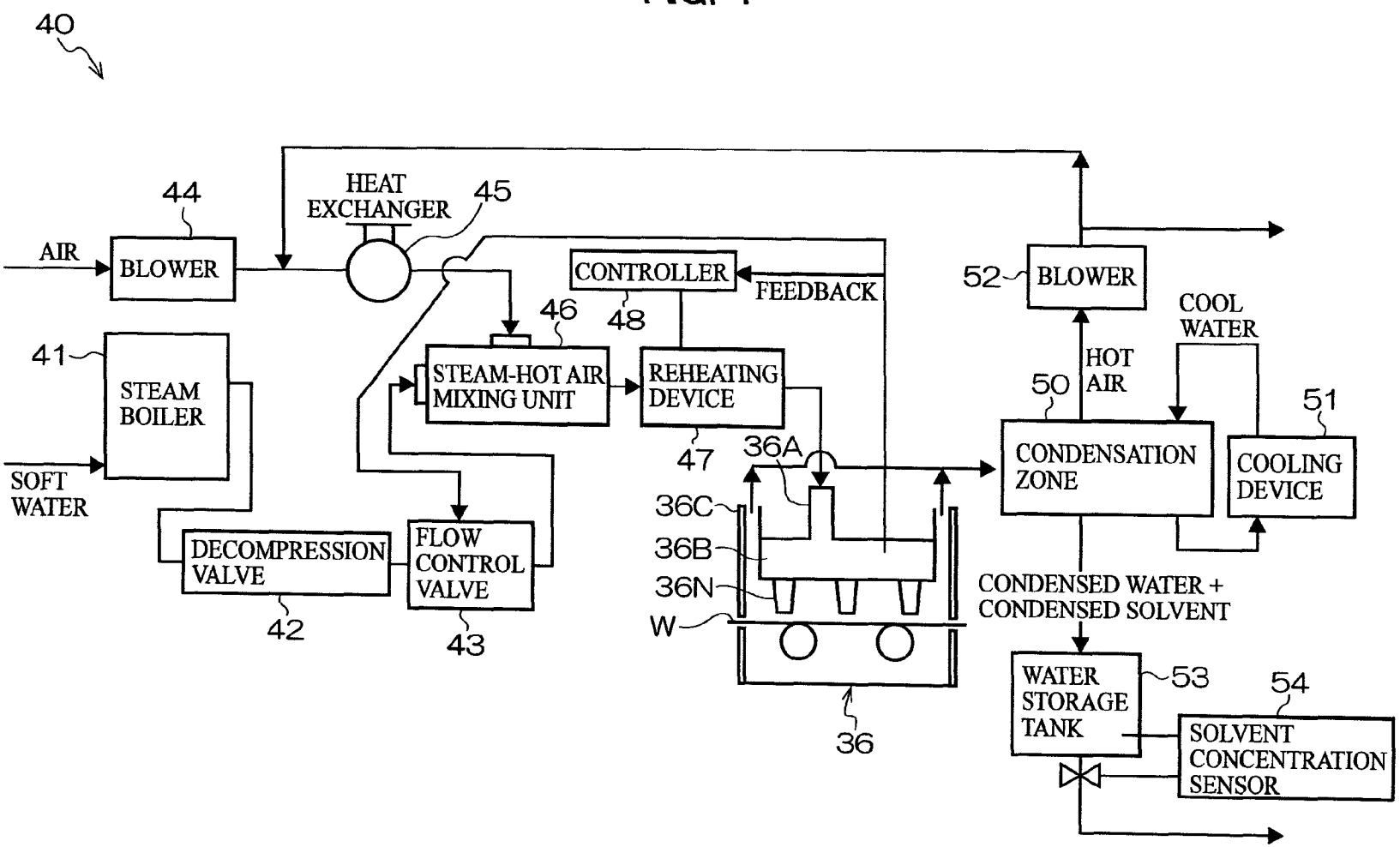
FIG. 4 shows the schematic structure of the steam-containing hot air generating system according to an exemplary embodiment of the invention.

Steam-containing hot air is supplied from the steam-containing hot air generating system 40 to the steam-containing hot air drying unit 36. FIG. 4 shows the schematic structure of the steam-containing hot air generating system 40. The steam-containing hot air generating system 40 includes a steam boiler 41 and a heat exchanger 45.

Soft water is supplied to the steam boiler 41, and the soft water is evaporated. The steam generated in the steam boiler 41 is decompressed to a predetermined pressure by a pressure reducing valve 42, and the flow rate of the steam is controlled by a flow control 43, and then the steam is sent to the steam-hot air mixing unit 46. The humidity in the rectifying box 36B is fed back to the flow rate control valve 43, and the flow rate is controlled by the flow rate control valve 43 according to the humidity.

Air is supplied from a blower 44 to the heat exchanger 45, and the air is heated by the heat exchanger 45 to turn into hot air. The hot air is sent to the steam-hot air mixing unit 46.

In the steam-hot air mixing unit 46, the hot air is mixed with steam, and the steam-containing hot air generated by mixing is sent to a reheating device 47. The reheating device 47 is connected to a controller 48. The controller 48 receives feedback on the internal temperature of the rectifying box 36B, and the steam-containing hot air is reheated in the reheating device 47 on the basis of the temperature.

The reheated steam-containing hot air is sent from the reheating device 47 to the steam-containing hot air drying unit 36. The steam-containing hot air is blown by the blowoff nozzles 36N on the surface of the aluminum web W. The organic solvent is thus removed from the undercoat layer.

The steam-containing hot air supplied from the reheating device 47 has a temperature of 90° C. to 200° C., and a relative humidity of 8% to 70%. The temperature range of 90° C. to 200° C. defined herein is commonly used for drying an undercoat layer. The relative humidity of 8% or more is specific to the invention. When the relative humidity is 8% or more, steam is absorbed in the undercoat layer coating to increase the free volume in the coating, and resultantly the diffusion rate of the residual solvent in the coating remarkably increases to accelerate the removal of the solvent. The relative humidity must be 70% or less. If the humidity is more than 70%, steam is excessively absorbed in the coating, and drying of the absorbed moisture takes a long time in the subsequent step. Therefore, the relative humidity must be 70% or less.

The steam-containing hot air supplied from the reheating device 47 preferably has a temperature of 110° C. to 170° C., and a relative humidity of about 10% to 45%.

The organic solvent used in the present exemplary embodiment has a relatively high boiling point, so that the completely removal of the organic solvent remaining in the undercoat layer usually requires the use of dry hot air having a high temperature. However, as exemplified by the present exemplary embodiment, the use of steam-containing hot air having a relative humidity of 8% to 70% allows quick removal of the residual organic solvent at a relatively low temperature.

The steam-containing hot air supplied to the steam-containing hot air drying unit 36 is discharged into an exhaust port 36C, and then sent to a condensation zone 50. In the condensation zone 50, the discharged steam-containing hot air is cooled by the cooling device 51. Thus the steam and organic solvent steam are liquefied to turn to condensed water and condensed solvent, respectively, which are sent to a water storage tank 53. The concentration of the condensed solvent sent to the water storage tank 53 is detected by a solvent concentration sensor 54. The condensed water and condensed solvent are discharged from the water storage tank 53 after being subjected to predetermined treatment. Hot air is returned from the condensation zone 50 to the heat exchanger 45 through a blower 52, while a portion of the hot air is exhausted.

The second drying step in the second drying unit 38 is described below.

In the second drying unit 38, the hot air fed from the hot air supply unit 38D is blown by the blowoff nozzles 38N on the aluminum web W thereby drying the aluminum web W to remove the steam absorbed in the undercoat layer. The hot air fed from the hot air supply unit 38D preferably has a temperature of about 60° C. to 200° C., and a relative humidity of about 0% to 2%.

In the present exemplary embodiment, the first drying step is carried out in the first drying unit 34, whereby the time until the undercoat layer reaches the dry point is reduced, and the organic solvent is effectively removed in the steam-containing hot air drying step. In addition, the second drying step in the second drying unit 38 removes the steam absorbed in the undercoat layer.

After the undercoat layer is dried in the undercoat layer applying/drying unit 30, the aluminum web W is cooled to normal temperature in the undercoat layer cooling unit 25, and sent to the image recording layer applying/drying unit 26. In the image recording layer applying/drying unit 26, the image recording layer 16 is applied and dried. The image recording layer 16 (top layer) is described below.

The image recording layer 16 is provided on the undercoat layer 14, contains a novolac resin and an infrared absorbing agent. The interaction between the infrared absorbing agent and the novolac resin is weakened by heat generated upon infrared laser exposure, which increases the solubility of the layer in an alkali developer thereby forming an image.

Examples of the novolac resin used in the invention include novolac resins such as a phenol formaldehyde resin, an m-cresol formaldehyde resin, a p-cresol formaldehyde resin, a m-/p-mixed cresol formaldehyde resin, and a phenol/cresol (m-, p-, or m-/p-mixed) mixed formaldehyde resin. The novolac resin preferably has a weight average molecular weight of 500 to 20,000 and a number average molecular weight of 200 to 10,000. The content of the novolac resin in the layer is preferably 50% by mass or more.

The infrared absorbing agent used in the image recording layer according to the invention is a dye having an absorption maximum at the wavelength of 760 nm to 1200 nm, and examples thereof include azo dyes, anthraquinone dyes, phthalocyanine dyes, carbonium dyes, quinoneimine dyes, methine dyes, squarylium dyes, and cyanine dyes. Among them, cyanine dyes are preferable, and the cyanine dyes expressed by the formula (I) in JP-A No. 11-218914 are particularly preferable. The content of the infrared absorbing agent in the layer is preferably from 0.1 to 10% by mass.

The image recording layer according to the invention may further contain another substance for substantially decreasing the solubility of the novolac resin (dissolution inhibitor), for example, an onium salt, an o-quinonediazido compound, an aromatic sulfone compound, or an aromatic sulfonate ester compound. The addition of the dissolution inhibitor increases the degree of insolubility of the image areas to the developer, and the addition of the compound allows the use of an infrared absorbing agent which does not interacts with the alkali-soluble resin. Examples of the onium salt include sulfonium salts, iodonium salts, diazonium salts, and phosphonium salts.

In the invention, examples of the other components added to the image recording layer include an image coloring agent and a fluorine surfactant for improving coating properties.

[Solvent]

The organic solvent used in the image recording layer preferably hardly elutes the polymer from the undercoat layer. Preferable examples of the solvent include methyl ethyl ketone, methanol, ethanol, propanol, ethylene glycol monomethyl ether, 1-methoxy-2-propanol, 2-methoxy ethyl acetate, 1-methoxy-2-propyl acetate, dimethoxyethane, and mixed solvents of them.

The coating weight of the image recording layer 16 (top layer) after drying is preferably from 0.05 to 1.0 g/m$^2$, more preferably from 0.07 to 0.7 g/m$^2$.

The coating solution for forming the image recording layer 16 (top layer) is applied to the undercoat layer 14. The application method is the same as that used for the application of the undercoat layer solution.

The coating solution for forming the image recording layer is applied by the above-described means, and then dried. The drying operation does not require the steam-containing hot air as used for the undercoat layer, but uses ordinary dry hot air.

After the image recording layer is applied and dried in the image recording layer applying/drying unit 26, the aluminum web W is cooled to normal temperature in the image recording layer cooling unit 27. Subsequently, the aluminum web W is sent to a winding device 28, and wound up into a web roll.

The web roll is supplied to a process line, where a protective interleaf paper is attached to the web, and the web is cut into a product size. Thus products of the positive photosensitive planographic printing plate are produced.

Example

Examples of the method for making a positive photosensitive planographic printing plate according to the present invention are described below.

An aluminum web W having a width of 1030 mm and a thickness of 0.3 mm was subjected to surface treatment in the surface treatment unit 22, coated with a substrate in the substrate applying/drying unit 23, and then subjected to undercoat layer drying treatment in the undercoat layer applying/drying unit 30. The applied undercoat layer solution contained the acrylic resin having an alkali-soluble group and the solvent as described above, and the coating was dried under the following conditions at different temperatures and humidities. The results are shown in [Table 1]. The evaluation used a positive photosensitive planographic printing plate having a width of 1030 mm and a length of 800 mm which had been made by cutting the aluminum web W, a setter LUXCEL T-9000HS manufactured by Fujifilm Corporation, and a TAF-FETA20 screen. A 50% screen tint was output, and developed using LP-1300HII loaded with DT-2 (1:8). The dot area at 70 points in total, composed of 10 points in the width direction (1030 mm) and 7 points in the vertical direction (800 mm), was measured with IC Ppate, and the difference between the maximum value and the minimum value was used for the evaluation of in-plane variation.

TABLE 1

| | Temperature | Relative humidity | Dot area | | |
|---|---|---|---|---|---|
| | (° C.) | (RH %) | Maximum | Minimum | Variation |
| Example 1 | 90 | 20 | 50.7 | 50.4 | 0.3 |
| Example 2 | 120 | 20 | 50.8 | 50.4 | 0.4 |
| Example 3 | 150 | 20 | 51.0 | 50.5 | 0.5 |
| Example 4 | 200 | 20 | 51.1 | 50.6 | 0.5 |
| Example 5 | 120 | 8 | 50.9 | 50.4 | 0.5 |
| Example 6 | 120 | 50 | 50.6 | 50.2 | 0.4 |
| Example 7 | 120 | 70 | 50.5 | 50.0 | 0.5 |
| Comparative Example 1 | 140 | 0.8 | 52.4 | 50.5 | 1.5 |

These results indicate that the use of the steam-containing hot air having a temperature of 90° C. to 200° C., and a relative humidity of 8% to 70% decreases the dot variation, and provides a positive photosensitive planographic printing plate with less sensitivity variation.

What is claimed is:

1. A method for making a positive photosensitive planographic printing plate comprising a base having formed thereon in this order an undercoat layer and an image recording layer, wherein the undercoat layer is obtained by applying an undercoat layer solution containing a solvent and an acrylic resin having an alkali-soluble group, followed by drying the coating, the image recording layer comprises a novolac resin and an infrared absorbing agent, and the applied undercoat layer solution is dried in an undercoat layer drying step which comprises a first drying step, a subsequent steam-containing hot air drying step using steam-containing hot air having a temperature of 90° C. to 200° C., and a relative humidity of 8% to 70%, and a second drying step following the steam-containing hot air drying step, wherein, in the first drying step, the applied undercoat layer solution is dried in a lower humidity than that in the steam-containing hot air drying step until the undercoat layer reaches a dry point, and the second drying step uses dry hot air having a relative humidity of about 0% to 2%.

2. The method for making a positive photosensitive planographic printing plate of claim 1, wherein the acrylic resin having an alkali-soluble group is a polymer containing a monomer unit having a phenolic hydroxy group, a sulfonamide group, or an active imide group

* * * * *